United States Patent [19]

Owens et al.

[11] Patent Number: 5,075,149

[45] Date of Patent: Dec. 24, 1991

[54] MOLDED HOLE REPAIR PATCH AND METHOD OF MANUFACTURE

[76] Inventors: R. Larry Owens, 2107 B Fairway Ct., Conyers, Ga. 30208; Paul G. McClellan, 1795 Mackinaw Pl., Smyrna, Ga. 30080

[21] Appl. No.: 475,923

[22] Filed: Feb. 6, 1990

Related U.S. Application Data

[63] Continuation-in-part of Ser. No. 262,703, Oct. 26, 1988, Pat. No. 4,959,251.

[51] Int. Cl.[5] ..... B32B 326; B32B 3/10

[52] U.S. Cl. ..... 428/138; 428/172; 428/354; 428/63

[58] Field of Search ..... 428/63, 138, 354, 172; 156/94

[56] References Cited

U.S. PATENT DOCUMENTS

| | | | |
|---|---|---|---|
| 2,833,327 | 5/1958 | Boyce | 428/63 |
| 3,819,467 | 6/1974 | Kovac | 428/138 |
| 4,120,715 | 10/1978 | Ockwell et al. | 428/138 |
| 4,122,222 | 10/1978 | Parker | 428/172 |
| 4,602,971 | 7/1986 | Bergeron et al. | 428/63 |
| 4,959,251 | 9/1990 | Owens et al. | 428/63 |

*Primary Examiner*—Alexander S. Thomas
*Attorney, Agent, or Firm*—Harry I. Leon

[57] ABSTRACT

A patch for the repair of a hole in an interior wall. This patch is easy to apply and requires no tools. The patch has a pressure sensitive adhesive layer which can be affixed to the wall surrounding the hole. Perpheral portions of the patch are thinner than that portion disposed over the hole itself and the outer surface of the patch is flat. The combination of tapering peripheral portions and a flat outer surface allows the path to be blended in with the rest of the wall so that the patch, when it is covered with paint, becomes unnoticeable. The patch is fabricated from a moldable plastic that is placed in a presss having opposing die faces which are flat and concave, respectively. The path is preferably reinforced for use on larger holes. The reinforcements can be made from a wide range of materials including metals, fiberglass and nylon. The paintability of any exposed surface of the patch may be enhanced by bonding a thin sheet of paintable material to the surface. The inner surface of the patch is coated with a pressure sensitive adhesive layer to allow the patch to be fastened quickly to the wall.

8 Claims, 3 Drawing Sheets

MOLDED HOLE REPAIR PATCH AND METHOD OF MANUFACTURE

CROSS-REFERENCE TO RELATED APPLICATION

This application is a continuation-in-part of application Ser. No. 262,703, filed Oct. 26, 1988, U.S. Pat. No. 4,959,251.

BACKGROUND OF THE INVENTION

The invention relates to devices and methods for repair and patching damaged plaster or drywall, which is sometimes referred to as sheetrock. Drywall, a material made of plaster of Paris or the like sandwiched between two cardboard sheets, is attached, in the form of panels, to two by four studs which are arrayed on 16 inch centers. But drywall is quite brittle and can be easily damaged. A sharp corner of a piece of furniture can easily gouge a hole in drywall.

In the past, the repair of a hole in drywall included placing a backing plate behind the drywall and then filling in the hole with a spackling compound or with plaster of Paris. This method of repair requires a plurality of steps that can span several days. A day or so is needed just for the original filling material to dry. But during the drying process, some shrinkage usually occurs. The patch must then be sanded and a second layer of filling material applied to level the hole. After another day or so, the patch on the wall is finally ready to paint.

Patches, which can be used to simplify construction, are also known. Hoffmann, U.S. Pat. No. 4,135,017, discloses a patch strengthened by a thin gage aluminum sheet which can be bonded to a wall using a two-sided adhesive tape. The exterior surface of Hoffmann's patch is covered with a fibrous material of sufficient porosity to allow a wall finishing compound to be bonded to it. To effect a smooth and virtually invisible repair, one must cover this fibrous material with a thin coating of plaster. Although the Hoffmann invention is an improvement over past methods, it still takes a long time to apply because the coating of plaster must be allowed to dry.

A device for repairing of holes in drywall which does not need to be coated with plaster is described in copending U.S. patent application Ser. No. 262,703 filed by Owens and McClellan. This device comprises a patch that can be applied to cover a hole in a wall, after which the area can be immediately repainted. The patch has an elastic body made from a semi-porous, rubber-like material which is capable of retaining a film of paint and which is backed by a pressure sensitive adhesive tape. Because this earlier device has an elastic body, it is best suited for use in covering relatively small holes.

SUMMARY OF THE INVENTION

The present invention is directed toward those working in the area of making repairs of holes in interior walls who wish to apply a patch and immediately paint over it without having to wait or return the following day to finish the job. Furthermore, the present invention answers the needs of those obligated to repair household and office areas in which large holes may be broken out of the wall.

The patch according to the present invention is a molded structure which may be reinforced with a thin plate of metal or a sheet of fiberglass or a tough plastic.

When so reinforced, the patch is made from a plate or sheet that is sandwiched between two thin sheets of a material such as polyester or the like bonded together by a molded adhesive material such as urethane. A metal plate which is sufficiently flexible to allow the outer surface of the patch to return to its original shape after the patch is struck by a force with a moderate impact is preferred. The polyester sheets are adhesively fastened to the metal plate with urethane. The polyester sheet on the front side forms a base to which paint can be applied. Alternately, this front sheet is treated with primer.

On the opposite side of the patch, a pressure sensitive adhesive layer is affixed to the back polyester sheet. Alternately, an adhesive may be sprayed onto the patch.

The process by which the patch in a preferred embodiment having a metal plate as reinforcement is fabricated comprises first placing a protective backing with a transferable, pressure sensitive adhesive layer upon the concave surface of a die forming the lower face of a press. The backing with the adhesive layer is laid on the die with the adhesive layer directed away from said concave surface. In succession, a first polyester sheet is inserted above the adhesive layer; and a first lump of urethane adhesive is then placed on this sheet. Subsequently, a perforated metal plate is laid on the first lump of urethane; a second urethane lump may be placed atop the plate metal, which is then covered by a second sheet of polyester which has previously been primed. Finally, all of the components of the patch including the urethane adhesive are pressed together, forming a laminated structure.

Alternately, the process by which the patch is fabricated comprises placing a moldable plastic upon the lower face of said press and then squeezing the plastic between the dies of the press.

The shape of the molded structure, whether it is made simply of a homogeneous plastic or includes reinforced laminated plies, is determined largely by the faces of the dies. The upper die, in contrast to the lower die with its concave face, has a very smooth flat surface. When the upper die is lowered and pressure applied to the various materials from which the patch is formed, a structure which is thicker at its center is formed. In use, the thickness of the structure at its center is virtually immaterial. After being removed from the press, the structure is trimmed completing fabrication according to the present invention.

With the patch being very smooth and flat on its exterior surface and thicker in the middle of its interior surface, the patch, once affixed on a wall with a sufficiently large hole, can be blended into the wall with one or more coats of paint. Moreover, the centrally disposed, convexly shaped, thickened portion of the patch adds strength and rigidity to the patch taking advantage of the presence of the hole.

DESCRIPTION OF THE PREFERRED EMBODIMENT

Figure 1:
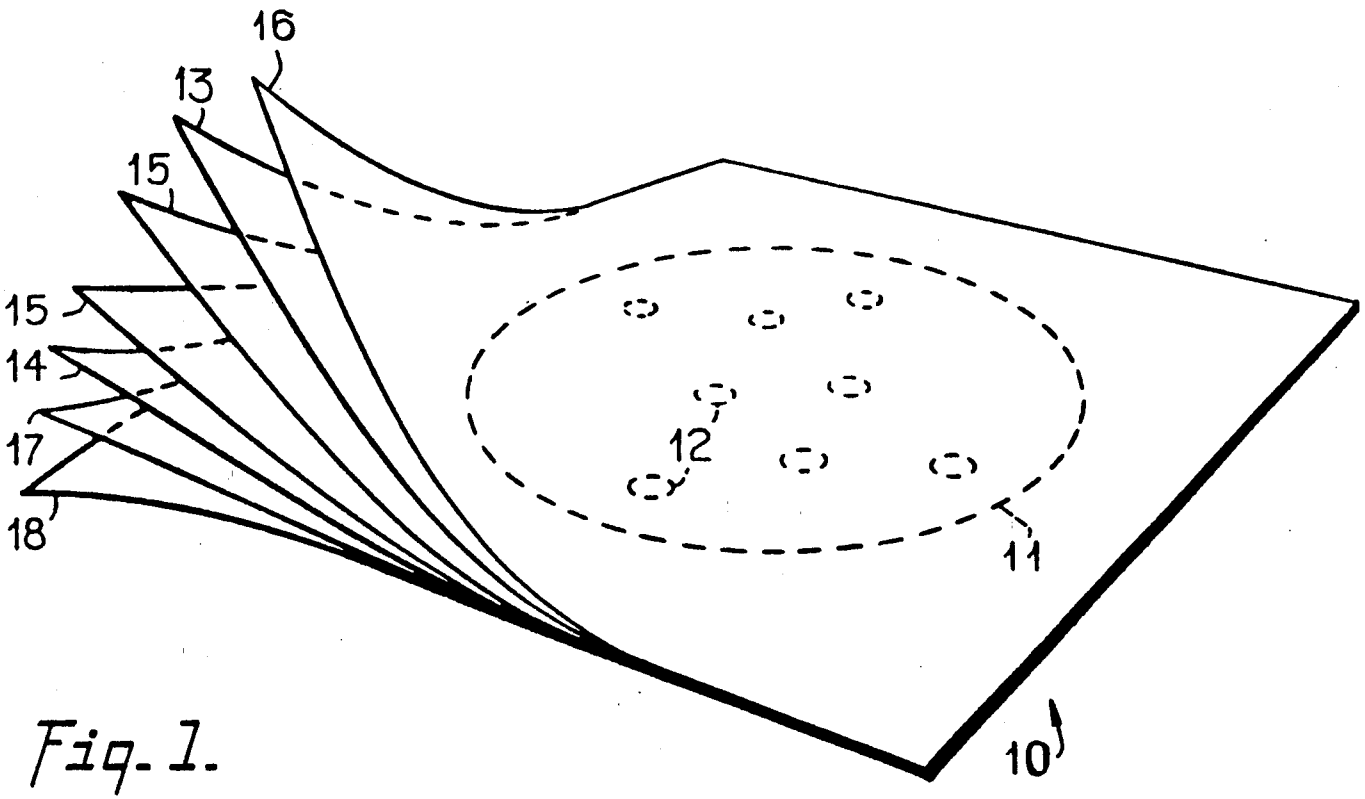
FIG. 1 is an partially exploded perspective view of one embodiment of the molded patch according to the present invention.
Figure 2:
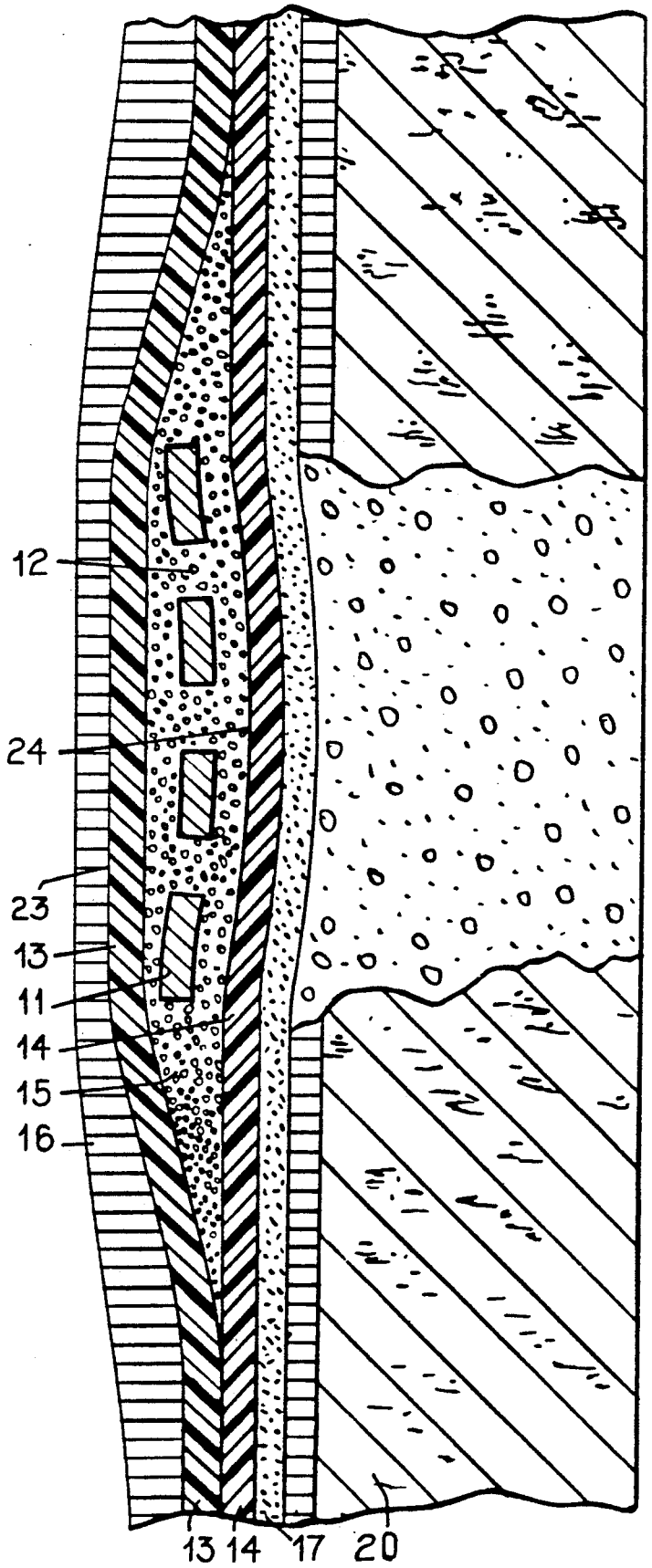
FIG. 2 is a side elevational view of the molded patch according to FIG. 1 in which the thickness of each of the layers of materials within the patch is exaggerated for clarity of illustration.
Figure 3:
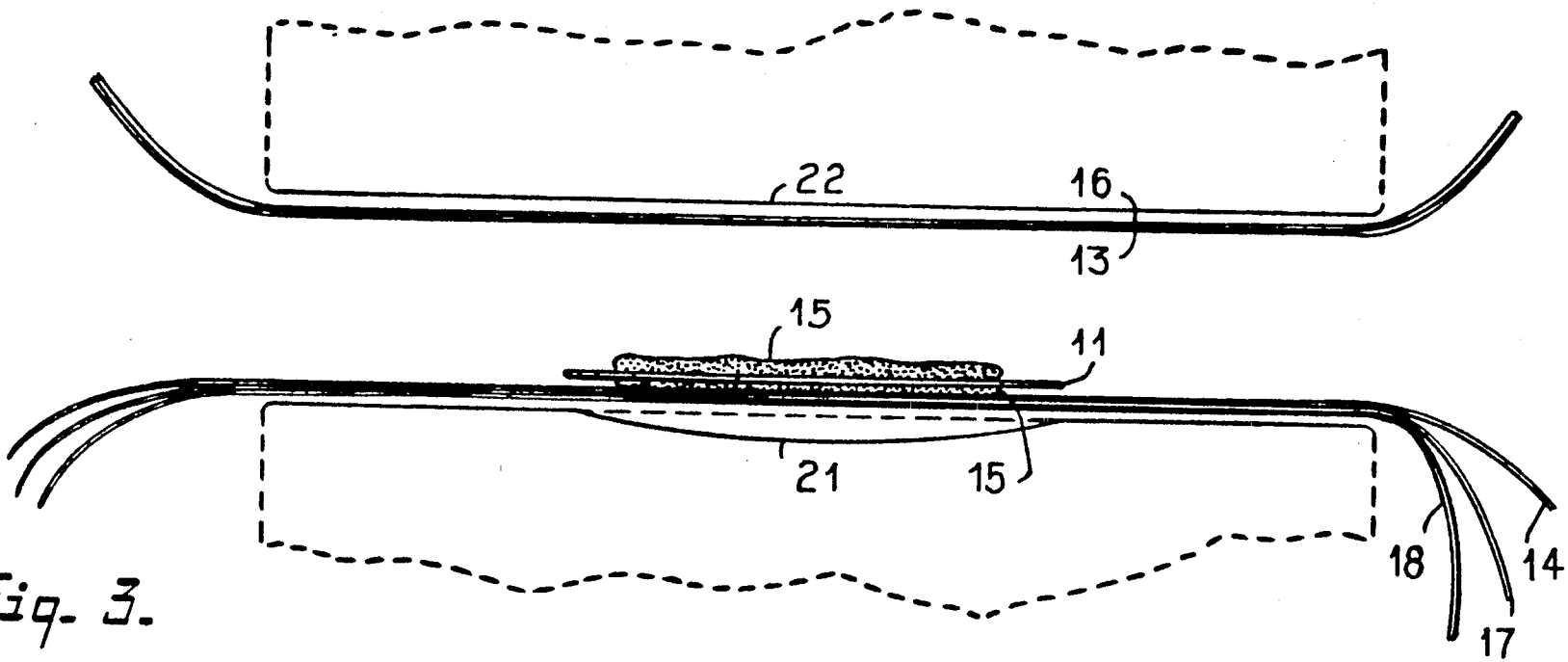
FIG. 3 is a side elevational view of the layers of material according to FIG. 2 as the materials are being loaded into a forming press.

Referring now to the drawings, a molded patch according to the present invention is indicated generally by the reference numeral 10. This patch is a composite material that includes a thin metal plate 11 in which is formed a plurality of holes 12. Alternately, a tough plastic sheet (not shown) made from such fabrics as nylon, polyester, polypropylene, acetate or even fiberglass can be used instead of the plate 11. The plastic sheet may be perforated or without holes.

On each side of the plate 11, a sheet of polyester material 13, 14 is fixedly attached to the plate by an adhesive 15. In the preferred embodiment, the outer surface 23 of sheet 13 is smooth and flat while the exposed surface 24 of sheet 14 is slightly convex. Without adding aesthetic or functional drawbacks, this convexity allows for the added thickness of the patch 10 in the cross-sections thereof which intersect the metal plate 11 and the adhesive 15.

A pressure sensitive adhesive layer 17 applied to the surface 24 of the polyester sheet 24 facilitates sticking the patch 10 to a drywall section. The exposed surface of the adhesive layer 17 is protected by a backing 18 which is removed just prior to mounting the patch 10 on a wall section 20. When the patch 10 is mounted on a wall, only a thin coating 16 of primer previously applied to the outer surface 23 is exposed to view. Alternately, the outer surface 23 can be left unprimed if otherwise treated to enhance its paintability such as by bonding a paintable, thin sheet (not shown) of paper or plastic to the surface.

The metal plate 11 is preferably fabricated from a stainless steel sheet with thickness varying between 1 to 12 mil. The adhesive 15 is a semi-solid urethane or the like. Each of the polyester sheets 13, 14 has a thickness in the range of approximately ½ mil to 3 mil. The coating 16 of primer, which is disposed on the exposed surface of the sheets 13, measures, by way of example, about ¼ mil thick.

The patch 10 is manufactured by placing the materials from which it is constructed on a suitable die having a lower face 21 and upper face 22. The upper die face 22 is smooth and flat while the lower die face 21 is concave. The degree of concavity of the face 21 can vary over a wide range, facilitating manufacture of the molded patch 10. The die is loaded as follows: first the backing 18 with the transferable, pressure sensitive adhesive layer 17 attached thereto is placed directly above the lower face 21. Next a sheet 14 of polyester is laid atop the adhesive layer 17. Alternately, a prefabricated material sheet having a backing 18 and a sheet 14 of polyester between which is sandwiched a pressure sensitive adhesive layer 17 is placed on the die with the backing disposed contiguous the lower face 21. A measured quantity of a semi-solid adhesive 15 that is capable of flowing under pressure such as urethane or the like is then placed atop the polyester sheet 14. Subsequently, the metal plate 11 is positioned horizontally on the middle of the sheet 14 and a second measured lump of adhesive 15 may be added, centered on the metal plate 11. Finally, a second polyester sheet 13 that has been precoated with a primer 16 is introduced above the second lump of adhesive.

The upper die 22 is then lowered and pressure is applied. The pressure causes the urethane adhesive 15 to flow around the edges of the plate 11 and through the holes 12, providing a smooth distribution of adhesive between the polyester sheets 13, 14. The sheets 13, 14 and the metal plate 11 becomes a single composite structure, thicker at its center, having a flat outer surface 23 coated with primer and a surface 24 that is slightly convex and protected by the backing 18.

In an alternate embodiment (not shown) a backing 18 with transferable, pressure sensitive adhesive layer 17 attached thereto is placed directly above the lower face 21. Next a moldable material such as urethane is placed upon the adhesive layer 17. Pressure is then applied to the moldable material as the upper die 22 is lowered. Again a molded structure, thicker at its center with a flat outer surface and a convexly shaped inner surface protected by a backing 18, is formed.

In applying the patch 10, the backing 18 is removed exposing the pressure sensitive adhesive layer 17. The patch 10 that may be affixed to the wall section 20 by applying a small amount of pressure. Once affixed, the patch 10 is ready to paint with the same interior paint used on the wall section 20.

It is apparent from the foregoing that a new and improved device for patching dry walls has been provided. The patch can also be used to patch other surfaces such as metal or plastic skins on automobile bodies. While only the presently preferred embodiment of the invention has been disclosed, as will be apparent to those familiar with the art, certain changes and modifications can be made without departing from the scope of the invention as defined by the following claims.

What is claimed is:

1. A patch for a hole in an outer face of a covering comprising:

(a) a generally flat laminated structure including at least three plies, a reinforcement sheet and a pair of material sheets, the pair of material sheets being fixedly attached to the reinforcement sheet which is sandwiched between them, one of the material sheets having a second surface directed away from the reinforcement sheet and being pretreated to enhance the paintability of the second surface; and (b) a pressure sensitive adhesive layer attached to a first surface of one of the material sheets, said first surface being directed away from the reinforcement sheet.

2. A patch for a hole in an outer face of a covering comprising:

(a) a generally flat laminated surface including at least three plies, a reinforcement sheet and a pair of material sheets, the pair of material sheets being fixedly attached to the reinforcement sheet which is sandwiched between them, one of the material sheets having a second surface which is directed away from the reinforcement sheet and which is approximately flat; and (b) a pressure sensitive adhesive layer attached to a first surface of one of the material sheets, said first surface being directed away from the reinforcement sheet, the first surface being convex.

3. A patch according to claim 2 which further comprises a primer pre-applied to a second surface of one of the material sheets, said second surface being directed away from the reinforcement sheet.

4. A patch according to claim 2 wherein a second surface of one of the material sheets, said second surface being directed away from the reinforcement sheet, is further characterized as being pretreated to enhance the paintability of the second surface.

5. A patch accodding to claim 2 wherein the reinforcement sheet is fabricated from a tough plastic.

6. A patch according to claim 2 wherein the reinforcement sheet is fabricated from fiberglass.

7. A patch according to claim 2 wherein the reinforcement sheet is fabricated from metal.

8. A patch according to claim 2 wherein the reinforcement sheet comprises a structure that is perforated.

* * * * *